United States Patent [19]

Yuen

[11] Patent Number: 4,535,698

[45] Date of Patent: Aug. 20, 1985

[54] PYROTECHNIC NOSE CAP FOR PRACTICE MUNITIONS

[75] Inventor: Harvard Yuen, Parsippany, N.J.

[73] Assignee: The United States of America as represented by the Secretary of the Army, Washington, D.C.

[21] Appl. No.: 548,902

[22] Filed: Nov. 4, 1983

[51] Int. Cl.[3] ..... F42B 9/20

[52] U.S. Cl. ..... 102/529; 102/521

[58] Field of Search ..... 102/520–523, 102/529, 513; 149/37, 15, 40, 19.6, 43; 702/374, 378

[56] References Cited

U.S. PATENT DOCUMENTS

| | | | |
|---|---|---|---|
| 3,411,963 | 11/1968 | Douda | 149/43 |
| 3,875,864 | 4/1975 | Ambrosini et al. | 102/703 |
| 3,983,816 | 10/1976 | Cornia et al. | 149/43 |
| 4,000,022 | 12/1976 | Beckert et al. | 149/19.3 |
| 4,062,709 | 12/1977 | Castaneda et al. | 102/290 X |
| 4,094,711 | 6/1978 | Ramnarce | 102/513 |
| 4,140,061 | 2/1979 | Campoli | 102/529 |
| 4,242,960 | 1/1981 | Boeder et al. | 102/529 X |

FOREIGN PATENT DOCUMENTS

| | | | |
|---|---|---|---|
| 3045129 | 6/1982 | Fed. Rep. of Germany | 102/529 |

*Primary Examiner*—Harold J. Tudor

*Attorney, Agent, or Firm*—Anthony T. Lane; Robert P. Gibson; Edward F. Costigan

[57] ABSTRACT

In a practice ammunition including a self-destruct, fin-stabilized subprojectile containing an elongated body composed of a plurality of mating segments having means for releasably holding said segments together, the means includes a heat sensitive nose cap including a pyrotechnic composition, which contains a fuel and an oxidizing agent. The nose cap holds the forward portions of the segments together, and due to the pyrotechnic composition, is adapted to burn and disintegrate essentially instantaneously in flight at a predetermined aerodynamic temperature to release the segments, whereby the distance at which the subprojectile self-destructs in its trajectory can be realized more accurately and reliably.

1 Claim, 4 Drawing Figures

PYROTECHNIC NOSE CAP FOR PRACTICE MUNITIONS

GOVERNMENT RIGHTS

The invention described herein may be manufactured, used and licensed by the Government for Governmental purposes without the payment to me of any royalties thereon.

BACKGROUND OF THE INVENTION

The present invention relates to an improved short-range practice round for simulating a kinetic energy type armor-piercing ammunition round, which includes an armor-piercing subprojectile mounted in a full-caliber discarding sabot and is fired from tank or other cannon at high velocities.

U.S. Pat. No. 4,140,061 discloses a practice round of the aforesaid type, which contains a self-destruct subprojectile composed of a plurality of contiguous elongated mating segments held together by a heat sensitive nose cap of metal. During flight the metal nose cap is heated aerodynamically, causing it to burn and disintegrate and thereby release the segments to tumble and decelerate and come to rest at a predetermined range. The nose cap recently employed was fabricated of a zinc alloy. However, the metal nose cap design is not completely satisfactory, since the disintegration thereof is progressive and relatively slow, so that it is difficult to achieve the exact time and range when the subprojectile aborts. The difficulty is further compounded by other factors which can influence the rate of heating of the nose cap, e.g. configuration and composition of the metal nose cap, projectile velocity, atmospheric temperature, etc.

SUMMARY OF THE INVENTION

An object of the present invention is to overcome the disadvantages of practice rounds of the type disclosed in U.S. Pat. No. 4,140,061.

In accordance with the present invention, there is provided an improved practice round of the type disclosed in U.S. Pat. No. 4,140,061, wherein the improvement resides in the use of a nose cap, which comprises a pyrotechnic composition containing a fuel and an oxidizing agent, in place of a metal nose cap, for holding the forward portions of the subprojectile segments together.

I have found that a pyrotechnic nose cap, in contrast to a heat sensitive metal (e.g. zinc alloy) nose cap, when heated to initiation temperature by atmospheric friction during flight of the projectile, is almost instantly and completely burned and disintegrated. This property of the pyrotechnic nose cap makes it possible to predetermine more accurately and dependably the point where the projectile is aborted in its trajectory and also permits a greater latitude in nose cap design and operation over a wider range of atmospheric temperatures.

DETAILED DESCRIPTION OF THE INVENTION

The present invention is described as an improvement in the practice round of the type disclosed in U.S. Pat. No. 4,140,061. However, this invention is not intended to be limited to the features disclosed in said patent, which are incorporated by reference herein, since it is obvious to one having ordinary skill in the art that the present invention is useful in other self-destruct practice rounds containing a multisegmented subprojectile.

Figure 2:
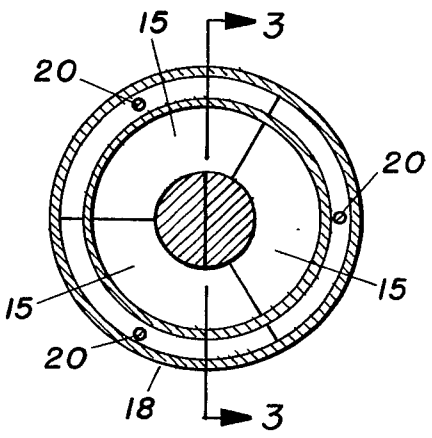
FIG. 2 is a transverse view taken on line 2—2 of FIG. 1.
Figure 1:
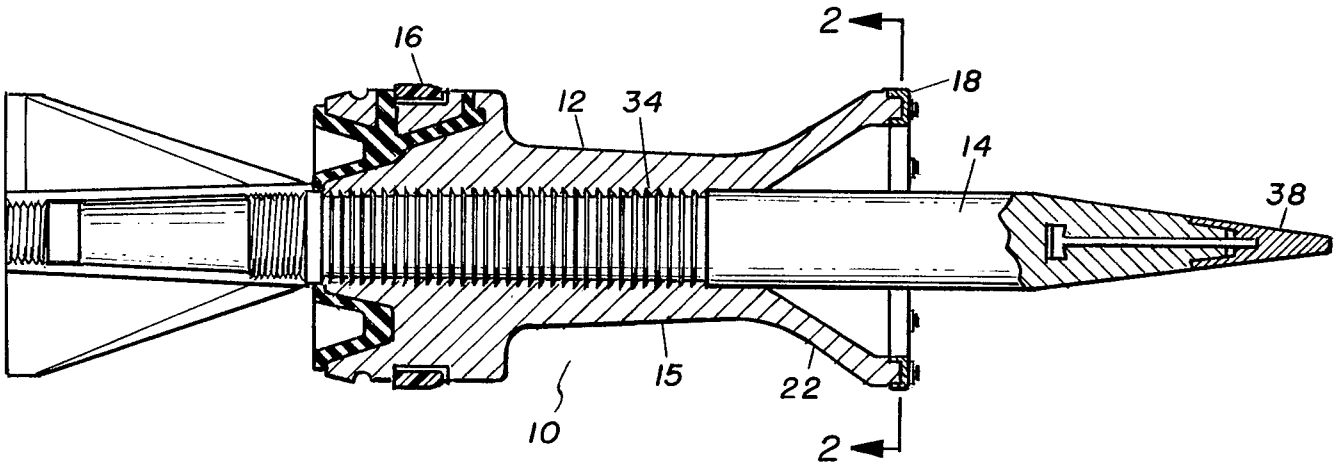
FIG. 1 shows a side view in partial section of a target practice projectile embodying the invention.
Figure 4:
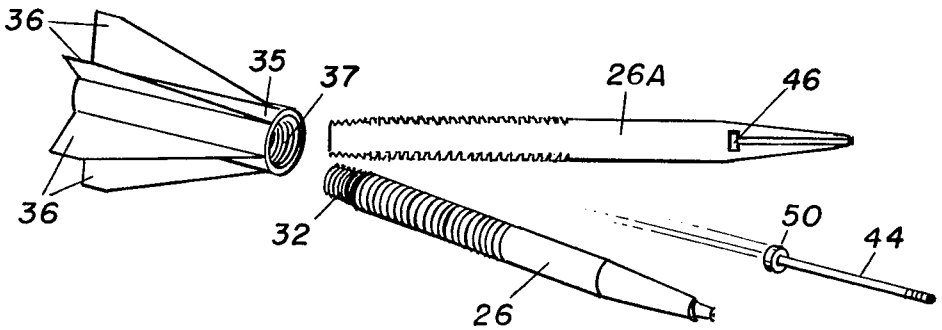
FIG. 4 is an exploded view of the segmented subprojectile illustrated in FIG. 1.
Figure 3:
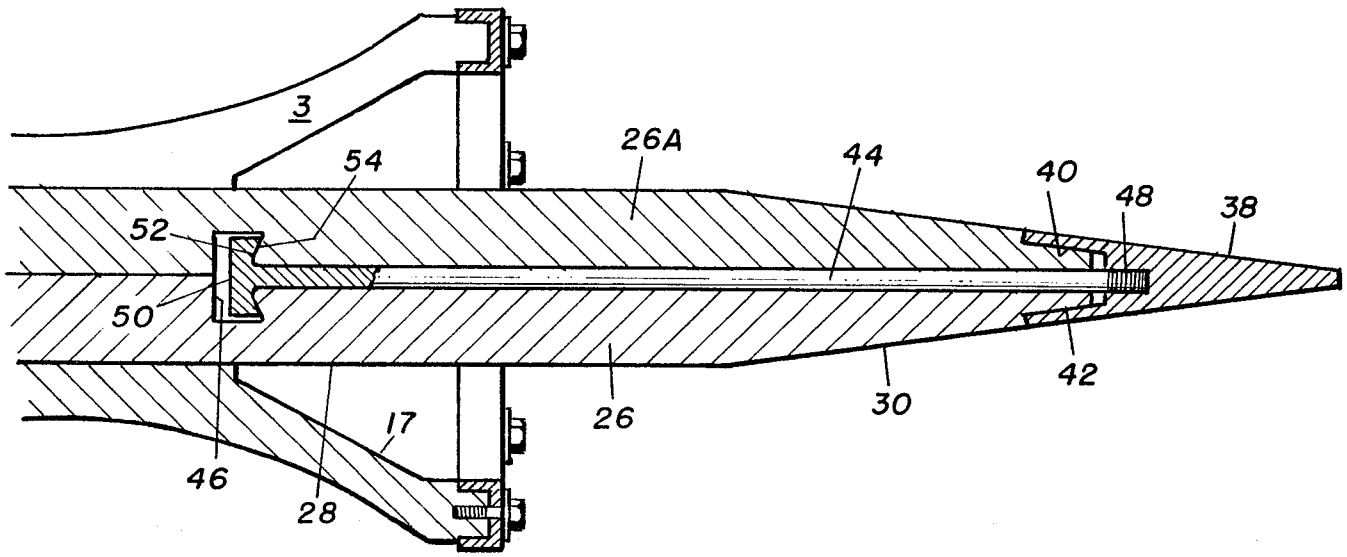
FIG. 3 is an enlarged axial section view of the front portion of the projectile shown in FIG. 1 taken on the line 3—3 of FIG. 2.

FIGS. 1, 2 3 and 4 illustrate a target practice projectile 10, which includes a full caliber annular discarding sabot 12 and a subcaliber self-destructing subprojectile 14. The sabot 12 is composed of three identical elongated metal or plastic segments 15, which are releasably clamped together in a circular array by a rear nylon obturator slip band 16 and a flanged annular metal band 18 attached by screws 20 to the forward ends of the outwardly flared portions 22 of the segments 15. The metal band 18 contains notches (not shown) to permit rupture of the band after the projectile 10 is launched from a rifled gun barrel (not shown). The nylon rear band 16 is ruptured at launch by muzzle gas pressure, after which the segments 15 swing out by centrifugal force and rupture the front band 18, whereby the sabot is discarded.

The subprojectile 14 includes two elongated metal segments 26 and 26A of semicircular cross-section nested together to form a cylindrical body 28 having a tapered front end 30 and a threaded rear end 32. The segments 26 and 26A fit snugly within the annular sabot 12 and are axially locked together by interlocking annular grooves and ribs, as shown at 34. A solid metal tail section 35 containing fins 36 and a threaded central bore 37 is threadably attached to the threaded rearward end 32 of the segmented cylindrical body 28.

The forward ends of the subprojectile segments 26 and 26A are releasably held together by means of a nose cap 38 fabricated from a pyrotechnic composition prepared as described below. The nose cap 38 is a cone-shaped member with a central tapered cavity 40 which fits over the annular stepped down portion 42 of the tapered forward end of the segmented cylindrical body 28. The nose cap 38 is axially held against the segments 26 and 26A by an elongated headed rod 44, which is seated in a headed axial bore 46 in the segments 26 and 26A and is threaded at 48 into the base of the nose cap cavity 40. The underside of the rod head 50 has a concave surface 52 which fits against a complemental surface 54 in the bore 46, and the base of the tapered bore 40 in the nose cap is spaced sufficiently from the front ends of the segments 26 and 26A to initially clamp the segments together and yet permit the segments to swing outward at the front ends upon initiation and disintegration of the pyrotechnic nose cap 38 by atmospheric friction during flight. The pyrotechnic nose cap 38 was fabricated as follows:

| Ingredient | Parts By Weight |
|---|---|
| magnesium, 200–325 mesh | 60 |
| Teflon ®, 130 microns | 30 |
| potassium nitrate, 36 microns | 20 |

-continued

| Ingredient | Parts By Weight |
|---|---|
| epoxy binder* | 10 |

*A mixture of Epon ® 828 resin and Versamide ® 40 hardener in weight ratio of 7:3. (Epon 828 is a liquid epoxy resin condensation product of epichlorohydrin and Bisphenol A marketed by Shell Chemical Co. Versamide ® 40 is a condensation product of polymerized unsaturated fatty acids with aliphatic amines marketed by General Mills, Chem. Div.

The ingredients were blended with sufficient acetone to form a homogeneous paste, which was then allowed to stand in air for 1–2 hours to evaporate the acetone. Before the epoxy resin had cured, the air-dried mixture was consolidated under a pressure of 3000–6000 psi in a cylindrical mold, after which the pressed pyrotechnic product was allowed to cure at room temperature for about 72 hours. The cured product was then machined to produce the nose cone of the configuration described above.

A sample of the cured product, when heated in an oven to initiation temperature, was almost instantaneously and completely burned.

The pyrotechnic nose cap thus obtained was employed in a 105 mm practice round containing a standard propelling charge and the self-destruct subprojectile described above with a full caliber discarding sabot. When the round was fired and the subprojectile had travelled a substantial distance in flight, the nose cone was heated by friction with the atmosphere to ignition temperature, whereupon it burned and disintegrated essentially instantaneously, releasing the subprojectile segments and causing the subprojectile to self-destruct at a predictable point in its trajectory. In comparison, when a metal nose cap made of zinc alloy was employed in place of the novel pyrotechnic nose cap, it burned and disintegrated less rapidly, so that the point at which the subprojectile aborted could not be predetermined as accurately and as reliably as with the pyrotechnic nose cap. This is due to the fact that the metal nose cap burns relatively slowly and progressively since it depends on atmospheric oxidation, whereas the pyrotechnic nose cap composition does not depend on atmospheric oxidation but contains a chemical oxidizing agent in sufficient amount to burn the fuel and disintegrate the nose cap completely and essentially instantaneously.

Other pyrotechnic compositions can be employed for fabricating a nose cap suitable for use in accordance with the present invention. The range of the practice round can be varied by varying the initiation temperature and composition and burning rate of the pyrotechnic nose cap as well as the size and shape of the frontal area thereof. As is well known, pyrotechnic compositions include the combination of a basic fuel such as powdered metals and metal hydrides, e.g. magnesium, boron and zirconium, with an oxidizing agent, such as potassium- and other alkali metal nitrates and -perchlorates and Teflon. Other ingredients may be present for special effects, e.g. dyes, color intensifiers etc. To form a strong structure suitable for use as a nose cap according to the present invention, the powdered ingredients are bonded together in known manner with a suitable binder, such as an epoxy resin, and acrylate resin or a vinyl resin. More specifically, as illustrated above, a satisfactory pyrotechnic nose cap can be fabricated by mixing the powdered ingredients, including a fuel, oxidizer and binding agent, with a volatile solvent, e.g. acetone or ethanol, to form a smooth paste, removing the solvent by evaporation, compressing the product to the desired density and curing the resin binder, if necessary, after which the product can be machined to the required size and configuration of the nose cap.

I claim:

1. In an improved practice munition having a self-destruct, fin-stablized sub-projectile with an elongated body having a convergent end poriton made of a plurality of contiguous mating segments, a discarding sabot mounted on said sub-projectile, a nose cap encompassingly mounted on said convergent end poriton holding said contiguous mating segments together during launch and initial flight prior to release thereof, the improvement consisting of:

a pyrotechnic nose cap containing 60 parts of magnesium, 30 parts of polytetrafluoroethylene, 20 parts of potassium nitrate and 10 parts of an epoxy binder, all parts being by weight based on the total weight of said nose cap, and said nose cap fully disintegrating after initial flight of less than 5 miles for the destruction of said subprojectile by the separating of said contiguous mating segments.

* * * * *